US007288707B2

(12) United States Patent
Swinkels

(10) Patent No.: US 7,288,707 B2
(45) Date of Patent: Oct. 30, 2007

(54) DEVICE FOR SETTING THE TENSION OF A SKIN OF A MUSICAL INSTRUMENT

(75) Inventor: Franciscus Johannes Marie Swinkels, Thorn (NL)

(73) Assignee: Adams Paukenfabriek B.V., Ittervoort (NL)

( * ) Notice: Subject to any disclaimer, the term of this patent is extended or adjusted under 35 U.S.C. 154(b) by 156 days.

(21) Appl. No.: 11/273,576

(22) Filed: Nov. 14, 2005

(65) Prior Publication Data

US 2006/0137045 A1 Jun. 22, 2006

Related U.S. Application Data

(60) Provisional application No. 60/628,012, filed on Nov. 15, 2004.

(30) Foreign Application Priority Data

Nov. 12, 2004 (NL) ..... 1027491

(51) Int. Cl.
*G10D 13/02* (2006.01)

(52) U.S. Cl. ..... 84/411 R

(58) Field of Classification Search ..... 84/411 R, 84/419, 421

See application file for complete search history.

(56) References Cited

U.S. PATENT DOCUMENTS 2,051,671 A * 8/1936 Au-Miller ..... 84/411 R 7,138,574 B1 * 11/2006 Spinazzola ..... 84/411 R

FOREIGN PATENT DOCUMENTS

| | | |
|---|---|---|
| DE | 1 024 321 | 2/1958 |
| DE | 42 35 792 | 4/1994 |
| DE | 198 32 401 | 1/2000 |
| NL | 6412329 | 4/1966 |
| NL | 1007471 | 5/1999 |

* cited by examiner

*Primary Examiner*—Kimberly Lockett
(74) *Attorney, Agent, or Firm*—Michaelson & Associates; Peter L. Michaelson

(57) ABSTRACT

The invention relates to a device for setting the tension of a skin, and a musical instrument such as a kettledrum provided with such a device. The device comprises a frame, a first link part and a second link part, both having a longitudinal direction, wherein, adjacent a first end, the first link part is connected to the second link part for pivoting relative to each other about a pivot which extends approximately at right angles to the longitudinal direction, while, adjacent a second end opposite the first end, the first link part is connected to setting means which comprise support means receiving support from the frame, which support means are located between the first and second end of the first link part, while adjacent a second end opposite the first end, the second link part comprises an operating face for operating means, while coupling means are connected to the second link part between the first end second end thereof, the first and second link part extending in said longitudinal direction at the same side of the pivot.

12 Claims, 3 Drawing Sheets

DEVICE FOR SETTING THE TENSION OF A SKIN OF A MUSICAL INSTRUMENT

CLAIM TO PRIORITY

This application claims the benefit of U.S. provisional patent applications entitled "DEVICE FOR SETTING THE TENSION OF A SKIN OF A MUSICAL INSTRUMENT", filed Nov. 15, 2004 and assigned Ser. No. 60/628,012, which is incorporated by reference herein.

The invention relates to a device for setting the tension of a skin, in particular for use in a musical instrument such as a kettledrum. Such a device is known from practice and is for instance supplied by Adams Paukenfabriek B. V., Thorn, the Netherlands.

The known device comprises a link which at a first side is provided with a pivot point and at an opposite, second side is provided with engagement means for an operating member while between the first and the second end coupling means are provided in the form of a pin having screw thread, for coupling to connecting means for the skin. The link is suspended in the first pivot point, with the coupling means being provided at a distance from the pivot point. During use, the coupling pin extends approximately vertically and is pulled in an upward direction under the influence of the tension of the skin. Energization of the operating means causes the link to pivot around the pivot point, so that the coupling means are pressed downwards. This increases the tension of the skin, as a result of which, for instance, the pitch of the instrument is raised. Moreover, the pitch can be influenced by adjusting the pivot point in vertical direction, in such a manner that the link will pivot approximately about the engagement means for the operating member, which also brings about a movement in vertical direction of the coupling means.

The drawback of this known device is that relatively much force is required for displacing the coupling means, in particular in the case of relatively high tension of the skin. This is disadvantageous, since it adversely affects the ease with which the instrument can be used. Moreover, due to the high forces that occur, the frame of the instrument subject to high load, while, in addition, there is the drawback that when the instrument is played, the skin will be displaced relative to the frame in a direction other than intended for setting the tension of the skin. A further drawback of this known device is that due to the high forces that occur, distributed unevenly over the frame, different vibrations will occur in different parts of the frame, which adversely affects the resulting tones, in particular in the high registers, in respect of both tonal purity and the duration of the tone.

Dutch patent NL1007471 describes a device for setting the tension of a skin, for instance for a kettledrum, wherein the link is divided in two parts, pivotal relative to each other and arranged in alignment.

Dividing the link into two link parts, which link parts are pivotally interconnected, offers the advantage that a more even distribution of the occurring forces over the frame of an instrument can be realized, while, moreover, the forces occurring in the first pivot point are reduced considerably. Thus, a number of the drawbacks of the earlier described devices are remedied. Such a device, however, is complicated and heavy.

The object of the invention is a device of the type mentioned in the opening paragraph, in which at least a number of the drawbacks mentioned are avoided while maintaining the advantages thereof. In particular, the object of the present invention is a device for setting the tension of a skin of a kettledrum or a like musical instrument, which device can be operated in a simple and ergonomically sound manner, while the sound of the musical instrument is further improved. To that end, a device according to the invention is characterized by the features of claim 1.

With a device according to the present invention, an operating device is used with a link divided into a first link part and a second link part. These two link parts are pivotally interconnected by a pivot, adjacent a first end of the two link parts. Both the first and second link part have a longitudinal direction and both are situated at the same side of the pivot. They therefore extend in substantially the same direction. The second end of the first link part is provided with an operating face for cooperation with operating means, while adjacent the second end of the second link part, setting means are provided for pre-setting the skin tension. Between the pivot and the second end of the first link part, coupling means are connected to the first link part, at a distance from the pivot. The second link part is provided, between the pivot and the respective second end, with support means, once more at a distance from the pivot. The support means receive support from the frame of the device.

During use, a movement of the coupling means is obtained, at least of its connection to the first link part, through movement of the operating face by means of the operating means. By means of the operating means, the first link part can be pivoted about the pivot so that, due to the distance between the pivot and the coupling of the coupling means to the first link part, a displacement of the coupling means is obtained. Furthermore, by means of the setting means, the second end of the second link part can be pivoted about the support means which receive support from the frame, causing displacement of the pivot. With this, a pre-setting of the coupling means can be realized.

With a device according to the present invention, a simple, compact build-up is obtained while the operating means and the setting means can extend at a same side. Thus, the device can be designed to be simple in operation and of particularly light construction, which can be of particular interest to musical instruments, in particular to musical instruments that have to be moved frequently for, for instance, storage and transport.

With a device according to the present invention, the support means and the coupling means are preferably closer to the pivot than to the respective second ends of the first and second link parts. As a result, a particularly favorable transmission ratio is obtained and a particularly accurate setting is possible without this costing much force. Preferably, the support means and the coupling means extend approximately next to each other viewed in a direction at right angles to the longitudinal direction. With this, a good transmission ratio and moreover, a simple construction are obtained in that the support means can receive support from the frame next to the coupling means, while the coupling means can be guided through the frame in a simple manner.

Preferably, the operating means comprise a rotation axis which can be rotated by, for instance, a foot pedal and is bearing-mounted in the frame, while a cam is connected to the rotation axis which cam receives support from the operating face. Rotation of the rotation axis will therefore cause the cam to move the operating face so that a rotation of the first link part about the pivot will be obtained.

The setting means can be designed in a particularly simple manner with a screw spindle and a screw block cooperating therewith, which screw block is preferably connected to the frame. The screw spindle can be connected to the second end of the second link part in a simple manner, so as to be freely rotatable and pivotable, so that through rotation of the screw spindle in the screw block connected to the frame, a displacement of the second end relative to the frame and hence pivotal movement of the second link part relative to the support means is obtained. It is preferred that the support means comprise at least one roller which is rotatable about an axis approximately parallel to the pivot and whose outside surface receives support from the frame. As a result, forces acting on the support means can be applied to the frame virtually only at right angles to the frame which is particularly advantageous for a good force transmission.

In a particularly advantageous embodiment, the second link part is designed such that it comprises two parts extending in longitudinal direction approximately parallel to each other, wherebetween the first link part can be pivoted. With this, a light, constructively simple and compact construction is obtained. Preferably, the coupling means comprise a guide part which is guided into a guide opening of the frame such that a direction of movement of the coupling part is defined. In practice, it is preferred that the coupling part comprises an axis with a longitudinal direction which, during use, extends approximately vertically, while the longitudinal direction of the link parts includes an angle with the longitudinal direction of the coupling part, which is about ninety degrees and will naturally, to some extent, depend on the relative pivotal movement of the link parts with respect to each other and to the frame as a result of the setting of the operating means and the setting means.

It is preferred that the link parts extend between the legs of the frame, adjacent a bottom side of the frame, so that they do not project, at least not significantly, outside the frame, as a result of which they are well protected and furthermore, a compact device is maintained.

The invention further relates to a musical instrument provided with a device according to the present invention and a skin that can be set therewith. In a preferred embodiment, such a musical instrument is designed as a kettledrum.

Due to the evenly occurring forces, exerted by the device, an even load on the parts of the instrument, in particular the frame parts thereof, is obtained, so that no objectionable differences in vibrations will occur. Moreover, a particularly even distribution of forces on the skin is thereby obtained and maintained, so that no undesired displacements of the skin will occur. This produces an instrument which can be operated in a particularly suitable and simple manner with relatively low forces, and which has a particularly nice sound. Preferably, the support means are designed such that no lateral forces or moments will be transmitted so that the tonal quality and the ease of operation of the instrument are improved still further.

Further advantageous embodiments of a device according to the invention are described in the subclaims.

In clarification, embodiments of a device according to the invention will be described hereinbelow, with reference to the drawing.

In the drawing.

In the description of the drawings, corresponding parts have corresponding reference numerals.

Figure 1:
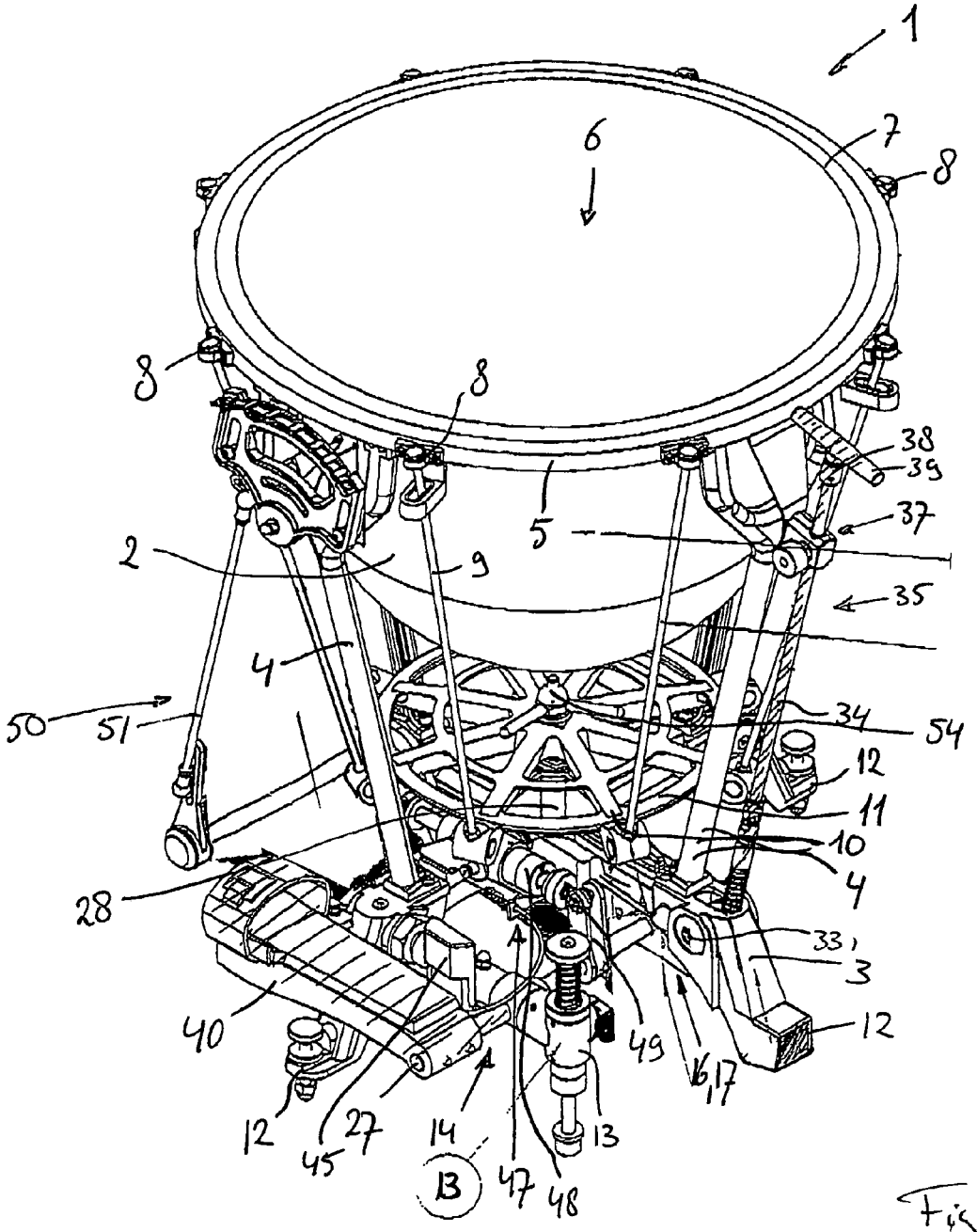
FIG. 1 shows a perspective side-view of a kettledrum according to the invention.

The kettledrum 1 as shown in FIG. 1 comprises a kettle 2, supported on a frame 3 via four support rods 4. The support rods 4 have their top ends connected to a hoop 5 within which the kettle 2 can be suspended. The kettle is manufactured from metal and serves as sound box. Over the kettle 2 and the hoop 5, a skin 6 is stretched by means of a tensioning ring 7 provided at the top side along the outside of the hoop 5. By means of clamps 8 and tensioning rods 9 connected thereto and extending along the kettle 2, the tensioning ring 7 is pulled in downward direction, thereby tensioning the skin 6. The bottom ends of the tensioning rods 9 are connected to arms 10 of a tensioning star 11, eight arms in the embodiment shown. The ends of the arms 10 comprise setting means capable of cooperating with setting means on the tensioning rods 9 for setting the length thereof, so that all tensioning rods 9 between the clamps 8 and the arms 10 of the tensioning star 11 have equal lengths, as a result of which the tensioning star 11 extends at least substantially horizontally. The frame 3 is supported by a number of legs 12 and a blocking support 13, so that the kettledrum 1 can readily be displaced yet can also be positioned in a stable manner.

Figure 2:
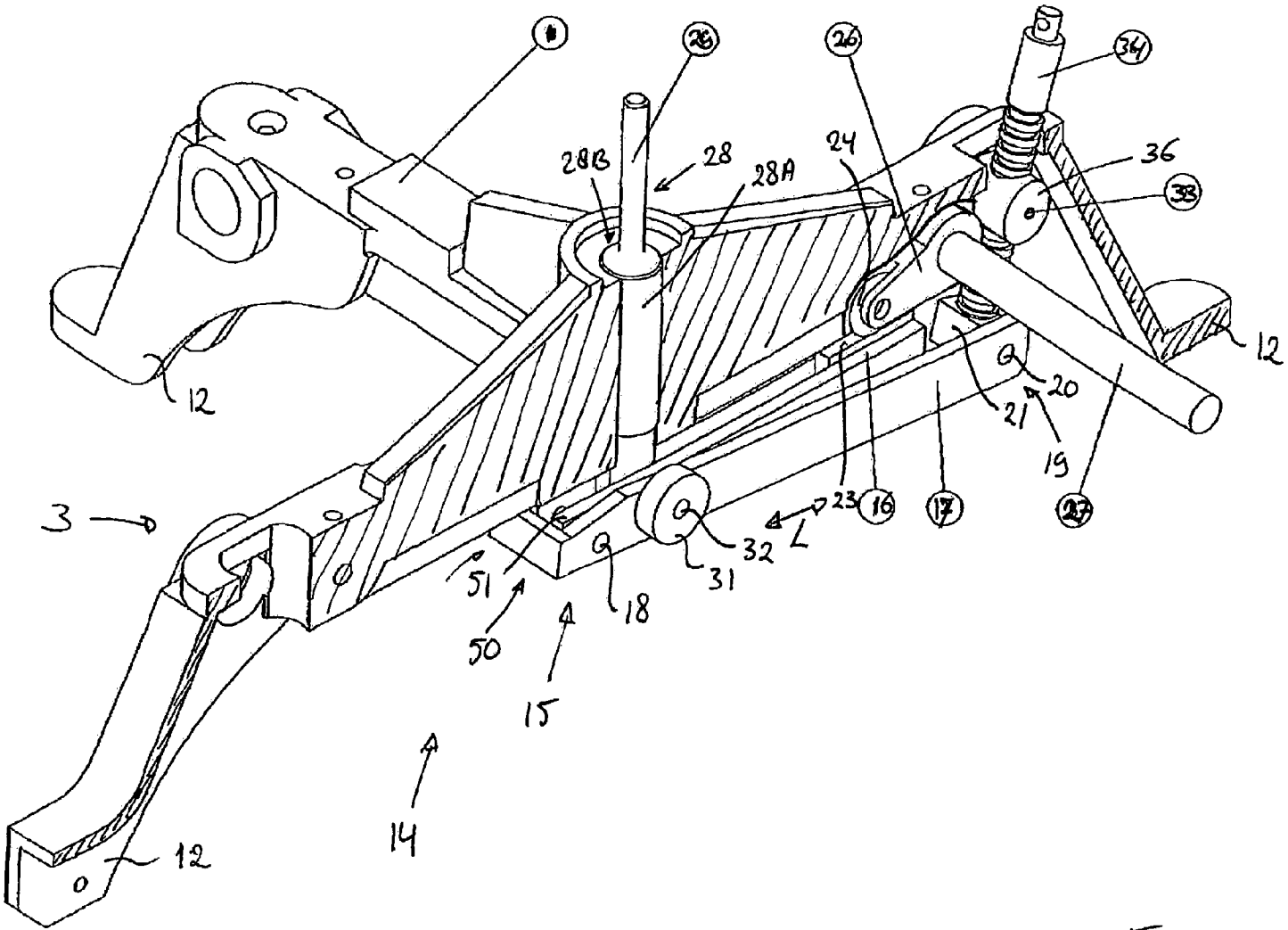
FIG. 2 shows, in perspective view, a cross-section through a vertical center plane of a tensioning device according to the invention for, for instance, a kettledrum according to FIG. 1.
Figure 4:
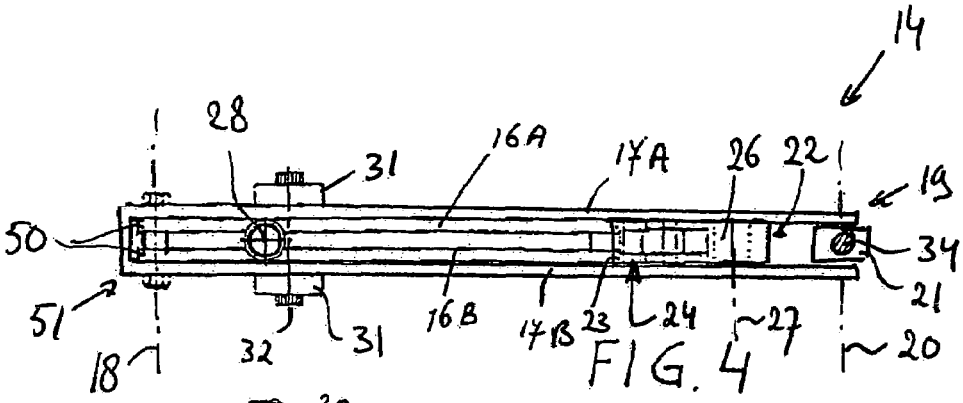
FIG. 4 shows a top plan view of an operating device according to FIG. 3.
Figure 3:
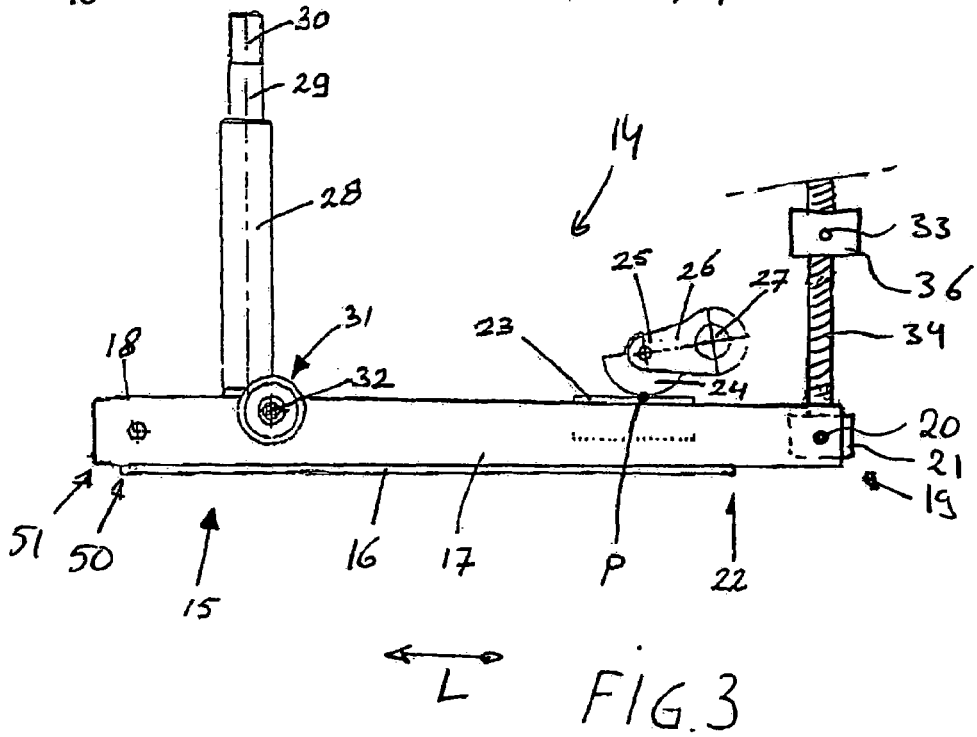
FIG. 3 shows a side-view of an operating device according to the invention without frame, for use in a kettledrum according to FIGS. 1 and 2.

The tension in the skin 6 can be adjusted through vertical movement of the tensioning star 11, as the clamps 8 and, accordingly, the tensioning ring 7 to which the skin 6 is connected are thereby moved in vertical direction, pulling the skin 6 tauter or less taught, depending on the direction of movement of the tensioning star 11. For obtaining a vertical movement of the tensioning star 11, an operating device 14 is provided, as shown in FIGS. 2-4. Here, this operating device 14 will be specified first, after which the position and the use thereof in a kettledrum according to FIG. 1 will be explained in more detail.

The operating device 14 comprises a link 15, composed of a first link part 16 and a second link part 17, which link parts 16, 17 are bearing-mounted adjacent a first end 60, 61 on a pivot 18 for pivoting relative to each other, which pivot, during use, extends approximately horizontally and at right angles to the longitudinal direction L of the link 15. In the embodiment shown, the two link parts 16, 17 are manufactured from parallel plate parts 16A, 16B and 17A, 17B respectively, properly spaced apart by suitable sleeves and coupling pins. Adjacent a second end 19 of the second link part 17 (to the right in FIGS. 3 and 4), a second pivot 20 is provided, which is parallel to the first pivot 18 and pivotally connects a pivot block 21 to the second link part 17. As will be explained in more detail, a bottom end 53 of a fine-setting means 35 is rotatably but not translatably connected thereto. Adjacent the second end 22 of the first link part 16, a contact face 23 is provided on the top side of the first link part 16, which can be engaged by an engagement cam 24, which engagement cam 24 is connected to the free end 25 of a tilting cam 26 fixedly connected to an operating axis 27, as will be explained in more detail hereinbelow. Hence, through rotation of the operating axis 27, the tilting cam 26 can be operated, causing the engagement cam 24 to press against the contact face 23 for moving the second end 22 of the first link part 16 in substantially vertical direction. Between the contact point P between the engagement cam 24 and the contact face 23 and the pivot 18, a slightly pivotable coupling pin 28 is connected, as coupling means to the first link part 16, which coupling pin, during use, extends approximately in vertical, upward direction. The top end of the coupling pin 28 comprises a reduced portion 29 having screw thread 30 at the free end thereof. The reduced portion 29 can be passed through a central hole in the tensioning star 11, after which the tensioning star 11 can be fixed onto the coupling pin 28 by means of a nut 54 fitting the screw thread 30 of the coupling pin 28.

On either side next to the coupling pin 28, a support means 31 in the form of a bearing is provided on the second link part 17, which support means can freely rotate about a rotation axis 32 extending parallel to the first pivot 18 and the second pivot 20. During use, these support means 31 can be supported by a part of the frame 3, in particular by the bottom side of a central part thereof. This means that by the support means 31, substantially only vertical forces can be transmitted, while lateral movements thereof will hardly lead to force transmissions. The coupling pin 28 can move freely between the plate parts 17A and 17B of the second link part 17, to freely enable a vertical movement of the coupling pin 28 relative to the second link part 17.

The coupling pin 28 comprises a guide part 28A which is fittingly guided through an opening 28B in the frame 3, so that only axial movement of the coupling pin 28 is possible.

During use, the tensioning star 11 is fixedly connected to the top end of the coupling pin 28, as described hereinabove, which will cause the link 15 to be pulled upwards each time, due to the tension in the skin 6, in such a manner that at least the support means 31 abut against the above-mentioned part of the frame 3. As indicated, the pivot block 21 is connected to a bottom end of a spindle 34 of the fine-setting means 35. For that purpose, a third pivot 33 extends through a screw block 36 thereby connecting it pivotally to the frame 3. The screw block 36 has internal screw thread which can cooperate with screw thread on the spindle 34 designed, as least partly, as screw spindle, so that this can be moved in axial direction relative to the frame while taking along the pivot block 21. Adjacent the top end of the spindle 34, a bearing 37 is provided, fixedly connected to a holding support 4, in which the spindle 34 is freely rotatable. Mounted on the top end of the spindle 34 is a knob 38 having a handle 39 whereby the spindle can be rotated.

Rotation of the spindle 34 results in that the spindle 34 is moved in axial direction while taking along the pivot block 21. This will involve the second link part 17 pivoting about the rotation axis 32 of the support means 31 such that the first pivot 18 will be moved up or down, depending on the direction of rotation of the spindle 34. As a result, the first link part 16 will pivot, approximately around the engagement point P between the engagement cam 24 and the contact face 23, while taking along the coupling pin 28 in a direction opposite to that of the second pivot 20. Since the support means 31 receive support from a central part of the frame 3 and the second pivot 18 is located closer to the rotation axis 32 than to the second pivot 20, a particularly advantageous force transmission is obtained, enabling fine adjustment of the tension in the skin 6 by means of the fine-setting means 35 in a particularly light and simple, accurate manner, without changing the position of the engagement cam 24. Indeed, the vertical movement of the coupling pin 28 brings about a corresponding vertical movement of the tensioning star 11, with the above-described effect of changing the tension in the skin 6.

Provided on one side of the frame 3 is a foot pedal 40, fixedly connected to the operating axis 27. Along the foot pedal 40 extends a blocking pedal 45 connected to a blocking mechanism which will not be further described, so that movement of the foot pedal 40 can thereby be blocked or released. The operating axis 27 extends approximately horizontally below the kettle 2, at right angles to the longitudinal direction L of the link 15 and is bearing-mounted in the frame 3 in a manner known per se. Hence, during use, the operating axis 27 can be rotated about its longitudinal axis by means of the foot pedal, at least after release of the slide bearing 43, so that the tilting cam 26 is moved thereby, while moving the engagement cam 24 in at least vertical direction. If the tilting cam 24 is moved upwards, the first link part 16 will pivot about the first pivot 18, leftwards in FIG. 3, causing the coupling pin 28 to be pulled up under the influence of the tension in the skin 6, which skin tension will hence decrease. If, on the other hand, the engagement cam 24 is moved downwards, the first link part 16 will pivot rightwards in the position shown in FIG. 3, i.e. it will pivot clockwise around the first pivot 18, while taking the coupling pin 28 along downwards, causing the tension in the skin 6 to be increased in the manner described hereinabove and thereby raising the pitch. By means of the blocking pedal 45, the operating axis 27 can be locked in any desired position, whereby the engagement cam 24 can likewise be fixed in any desired position. As under the influence of the tension of the skin, the coupling pin 28 is always biased in vertical, upward direction, a pivotal movement of the first link part 16 will hardly, if at all, influence the position if the second link part 17. Because of the ratio between on the one hand the distance between the first pivot 18 and the longitudinal axis of the coupling pin 28, and on the other hand the distance between the first pivot 18 and the engagement point P between the engagement cam 24 and the contact face 23, a favorable transmission ratio is obtained. The distance between the first pivot 18 and the longitudinal axis of the coupling pin 28 is preferably considerably less than the distance between the first pivot 18 and this engagement point P.

By way of illustration, a number of ratios are given, which should not be construed as being limitative in any way. The distance between the first pivot 18 and the longitudinal axis of the coupling pin 28 is for instance one-fifth of the distance between the first pivot 18 and the engagement point P, while the distance between the first pivot 18 and the rotation axis 32 of the support means 31 is, for instance, one-fifth of the distance between the rotation axis 32 and the second pivot 20. Of course, other ratios may be chosen, depending on the transmission ratios desired and the forces occurring.

Provided between the frame 3 and the operating axis 27 is a setting device 47, comprising a spring 48 whose tension is settable by means of a setting mechanism 49. The resistance of the foot pedal 40 can thereby be set, if so desired, while the changing skin tension can be compensated for. Arranged on one of the support rods 4 is a tone-indicating device 50, which is operated, via a rod 51, by an arm 52 on the operating axis 27. A change of position of the operating axis 27 effects a tilting of the tone-indicating device 50, so that a pre-set tone, that is to say tension of the skin 6, can be read. For clarity's sake, this is shown at the side of the pedal 40 but is preferably provided at the other side of the kettledrum 1.

As is apparent from the Figures, the foot pedal 40 can be provided at the same side of the kettledrum as the tilting cam 26 and the axis 27, and the fine-setting mechanism 35. As a result, a particularly compact operating device 14 is obtained which can furthermore be operated particularly well, in an ergonomically sound manner. The kettledrum 1 can be designed to be particularly light, relatively simply to construct and maintain and has a particularly nice sound.

The invention is not limited in any manner to the embodiments given in the Figures. Many variations thereto are understood to fall within the framework of the invention.

For instance, instead of the engagement cam 24, a connection between the tilting cam 26 and the second end 22 of the first link part 16 can be obtained, for instance by a pin extending through slots in the plate parts 16A, 16B of the first link part 16 and the free end 25 of the tilting cam 26, to obtain a fixed, yet sliding coupling between the first link part 16 and the tilting cam 26. Further, the support means 31 may be positioned differently, for instance at some distance from the coupling pin 28, while these means may be designed differently, for instance as slide bearings. Also, the support means may receive support in a different manner, for instance from the tensioning star. Also, a coupling between the link 15 and the tensioning star 11 may be realized in a different manner. Further, all kinds of variations may be applied to the shape and design of, for instance, the kettle, the coupling between the tensioning star and the skin, the tensioning star and the like. Moreover, an operating device according to the invention may be of a multiple design or for instance be used for a different percussion instrument, or for instance in measuring apparatus involving the use of tensioned skins. Further, the link parts may be designed differently, for instance as at least partially closed, solid parts, while, moreover, the fine-setting means may be of a different design. The foot pedal may also engage the operating axis via a transmission mechanism. In addition, the spindle may engage the link directly at or adjacent the first end thereof.

These and comparable variations are understood to fall within the framework of the invention.

The invention claimed is:

1. A device for setting the tension of a skin, in particular for use in a musical instrument such as a kettledrum, provided with a frame, a first link part and a second link part, both having a longitudinal direction, wherein, adjacent a first end, the second link part is connected to the first link part for pivoting relative to each other about a pivot extending approximately at right angles to the longitudinal direction, while, adjacent a second end opposite the first end, the second link part is connected to setting means which comprise support means receiving support from the frame, which support means are located between the first and second end of the second link part, while adjacent a second end opposite the first end, the first link part comprises an operating face for operating means, while coupling means are connected to the first link part between the first end second end thereof, the first and second link part extending in said longitudinal direction at the same side of the pivot.

2. A device according to claim 1, wherein the support means and the coupling means are located closer to the pivot than to the respective second ends of the first and second link parts.

3. A device according to claim 1, wherein the support means and the coupling means are situated approximately next to each other, viewed in a direction at right angles to the longitudinal direction.

4. A device according to claim 1, wherein the operating means comprise a rotation axis bearing-mounted in the frame on which an operating cam is provided which contacts the operating face such that upon rotation of said rotation axis the operating cam is pivoted, thereby displacing the operating face.

5. A device according to claim 1, wherein the setting means comprise a screw spindle and pivot block cooperating therewith, while the pivot block is attached to the second link part.

6. A device according to claim 5, wherein the screw block is pivotally connected to the second end of the second link part.

7. A device according to claim 1, wherein the second link part comprises two side parts arranged one next to the other and extending in longitudinal direction, wherebetween the first link part can be moved.

8. A device according to claim 1, wherein the support means comprise at least one roller, rotatable about an axis extending approximately parallel to the pivot, which roller receives support from the frame.

9. A device according to claim 1, wherein the coupling means comprise a guide part extending through a guide opening in the frame.

10. A device according to claim 1, wherein the frame has legs on which the device can be arranged on a surface and the first and second link part extend between the legs.

11. A musical instrument, provided with a skin and a device according to claim 1, wherein the coupling means are connected to the skin.

12. A musical instrument according to claim 11, wherein the instrument is a kettledrum, in particular a philharmonic kettledrum.

* * * * *